US007006647B1

(12) United States Patent
Wuersch

(10) Patent No.: US 7,006,647 B1
(45) Date of Patent: Feb. 28, 2006

(54) HEARING AID WITH A MICROPHONE SYSTEM AND AN ANALOG/DIGITAL CONVERTER MODULE

(75) Inventor: Christoph Wuersch, Niederurnen (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 09/502,258

(22) Filed: Feb. 11, 2000

(30) Foreign Application Priority Data

Feb. 11, 2000 (CH) ..... PCT/CH00/00081

(51) Int. Cl.
*H04R 25/00* (2006.01)

(52) U.S. Cl. ..... 381/324; 381/322

(58) Field of Classification Search ..... 381/92, 381/312, 313, 322, 356, 189, 324, 328; 181/129–130
See application file for complete search history.

(56) References Cited

U.S. PATENT DOCUMENTS

| | | | | |
|---|---|---|---|---|
| 4,187,413 A | | 2/1980 | Moser | |
| 4,956,868 A | * | 9/1990 | Carlson | 381/189 |
| 5,229,771 A | | 7/1993 | Hanlon | |
| 5,483,599 A | * | 1/1996 | Zagorski | 381/313 |
| 5,757,933 A | * | 5/1998 | Preves et al. | 381/313 |
| 5,777,568 A | | 7/1998 | Inoue | |
| 5,796,848 A | * | 8/1998 | Martin | 381/322 |
| 5,809,151 A | * | 9/1998 | Husung | 381/322 |
| 6,031,923 A | * | 2/2000 | Gnecco et al. | 381/322 |
| 6,069,963 A | * | 5/2000 | Martin et al. | 381/313 |
| 6,075,869 A | * | 6/2000 | Killion et al. | 381/356 |
| 6,137,887 A | * | 10/2000 | Anderson | 381/356 |
| 6,222,927 B1 | * | 4/2001 | Feng et al. | 381/92 |
| 6,236,731 B1 | * | 5/2001 | Brennan et al. | 381/312 |

FOREIGN PATENT DOCUMENTS

| | | |
|---|---|---|
| DE | 195 45 760 C1 | 2/1997 |
| DE | 196 35 229 A1 | 3/1998 |

* cited by examiner

*Primary Examiner*—Suhan Ni
(74) *Attorney, Agent, or Firm*—Pearne & Gordon LLP

(57) ABSTRACT

A hearing aid with a microphone system (1) and a subsequent analog/digital converter (5). The microphone system (1) is encapsulated in a shielding case (3) and the analog/digital converter (5) is mounted on the shielding case (3). The analog/digital converter (5) is encapsulated in a converter shielding case (7*a*, 7*b*) which is set to the potential of the microphone system shielding case (3). The microphone system (1) and the analog/digital converter (5) are releasably attached to one another in a modular manner.

10 Claims, 2 Drawing Sheets

HEARING AID WITH A MICROPHONE SYSTEM AND AN ANALOG/DIGITAL CONVERTER MODULE

BACKGROUND OF THE INVENTION

It is known to shield the microphone system of hearing aids against electromagnetic interference and to configure them with respect to acoustic resonance chambers. It is further known about hearing aids processing digital audio signals to use an analog/digital converter directly subsequent to the microphone system.

German patent 195 457 60 proposes configuring the analog/digital converter with the microphone system into one unit in the hearing aid and to shield both jointly against electromagnetic interference.

This design incurs a number of drawbacks:

Each further development of analog/digital converters on one hand and of the microphone system on the other hand requires a new design of the combined, integral unit, The advantage of one and the same analog/digital converter being combinable with various microphone systems, or that one and the same microphone system might be combined with different AD converters, is precluded as regards lowering the manufacturing costs of the individual components, When designing the microphone system, the analog/digital converter, which is integral therewith, must also be considered in the light of the acoustic resonance chambers directly coupled to the microphone.

SUMMARY OF THE INVENTION

The present invention is directed toward a hearing aid device that eliminates or minimizes at least some of the aforementioned disadvantages in the art.

In accordance with the present invention, the direct mechanical assembly of the analog/digital converter on the microphone system comprises a shielding case and remedies the above-noted drawbacks. Moreover, no practical drawbacks are sustained regarding electromagnetic shielding because the acoustic resonance spaces and the design of microphone/digital-analog-converter will not be degraded, while shielding remains optimal. Such a result is attained in a preferred embodiment, wherein the analog/digital converter is modular and is encapsulated, per se, in a shielding case which, when assembled, on the microphone system's shielding case can be placed snugly with vanishing conduction gaps, on the microphone system's shielding case so as to be at its potential.

In a further preferred embodiment, the microphone system and the analog/digital converter not only are each modular and undetachably joined, but the two modules may also be joined detachably.

In order to fully exploit the advantage of the design of the invention, in particular its modular aspect and the flexible use of one and the same analog/digital converter module for different applications, in particular different microphone systems, the invention includes an analog/digital converter module fitted with at least two analog inputs of different input impedance and/or different signal gains.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
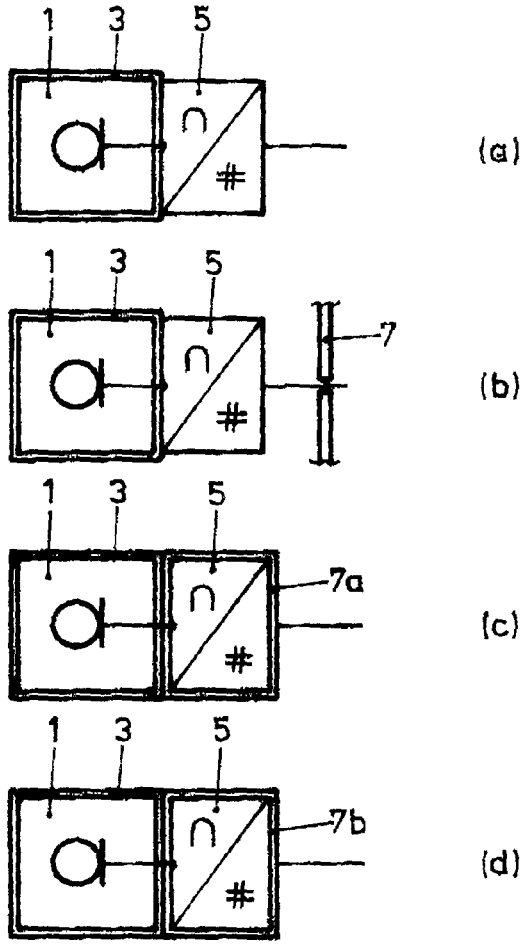
FIGS. 1*a*–1*d* schematically show the design, with different shielding concepts, of a unit of a microphone and an analog/digital converter, FIG. 2 schematically and in simplified manner shows a cross-section of the apparatus of the invention, and FIG. 3 schematically shows a preferred embodiment of a module of an analog/digital converter of the invention.

FIGS. 1*a*–1*d* schematically shows modes of the microphone system with a directly subsequent analog/digital converter of an (omitted) hearing aid. In FIG. 1*a*, a microphone system 1 is shielded against electromagnetic interference by a shield 3. The analog/digital converter 5 is mounted, in accordance with the present invention, on the shield 3 of the microphone system 1. In FIG. 1*b*, a further shield 7 is mounted at the output side of the analog/digital converter in particular also for the purpose of suppressing any electromagnetic interference from the output of the analog/digital converter being fed into its analog input. This feature is optimized in FIG. 1*c* in that the analog/digital converter 5 is, per se, encapsulated in a shield 7*a*. The illustrated variant is prefeffed because it allows modular use of the analog/digital converter 5 regardless of how and where further shielding is provided. In FIG. 1*d* the shield 7*b* of the analog/digital converter 5 is interrupted at one side, where shielding is completed by the shielding of the microphone system 1. In this instance, the outside shape of the microphone system, i.e., its shield 3 and the design of the analog/digital converter 5, are interrelated.

Figure 2:
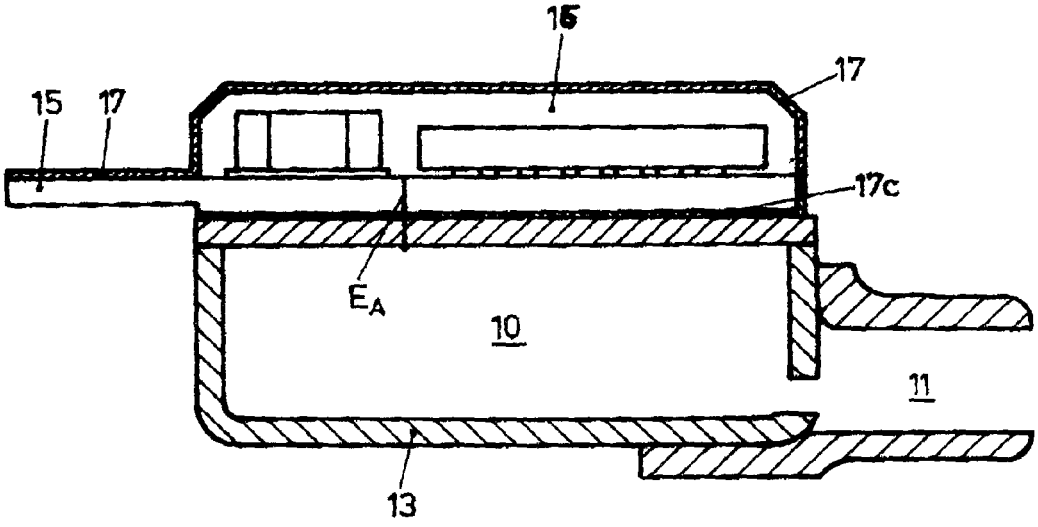

FIG. 2 illustratively and schematically shows the design of the combination of the microphone system and analog/digital converter. The shielding case 13 of the microphone system 10 is fitted with an acoustic input 11 and supports a flexible sheet 15 coated with conducting paths 17 of the digital output of the converter. The analog/digital converter 16 is encapsulated in a thin shield 17. The thin shield is preferably a metallized layer 17*c* of the sheet 15 and sits snugly enough on the shielding case 13 to be at the same electrical potential as the case 13. As is schematically illustrated in FIG. 2, the analog/digital converter is contained within the shield 17. Also, the analog input $I_A$ of the converter passes through both the sheet 15 and the corresponding zone of the shield 17 into the case of microphone system 10.

Figure 3:
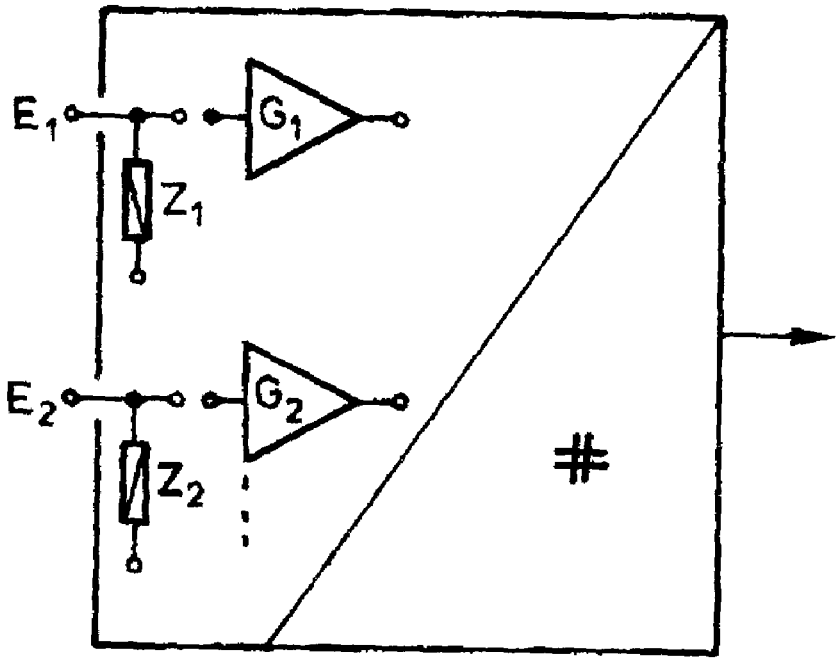

In a preferred manner and, as shown in FIG. 3, especially as regards the modular use of the analog/digital converter of the invention, the converter shall be basically applicable with different input configurations. Illustratively, it may have at least two inputs $I_1$ and $I_2$ of different input impedance, $Z_1$ and $Z_2$, and/or with different input gains, $G_1$ and $G_2$, and where called for with different analog/digital conversion functions. As a result, the analog/digital converter allows flexible application in different microphone systems.

While the preferred embodiments of the present invention have been illustrated and discussed hereinbefore, it is understood that the present invention is not limited thereto. Rather, the invention is defined by the claims attached hereto.

What is claimed is:

1. A hearing aid comprising a microphone system and a subsequent analog/digital converter, wherein the microphone system is encapsulated in an electromagnetic shielding case forming a shielded microphone system unit, and further wherein the analog/digital converter is mounted on an outer surface of the electromagnetic shielding case.

2. The hearing aid as claimed in claim 1, wherein the analog/digital converter is encapsulated in a converter shielding case and is mounted to said outer surface via said converter shielding case which is set to the electrical potential of the electromagnetic shielding case of the microphone system.

3. The hearing aid as claimed in claim 1, wherein the microphone system and the analog/digital converter are detachable combined in a modular manner.

4. The hearing aid as claimed in claim 2, wherein the microphone system and the analog/digital converter are detachable combined in modular manner.

5. The hearing aid as claimed in claim 1, wherein said analog/digital converter comprises first and second analog inputs, said first analog input having a first input impedance and a first input gain, said second analog input having a second input impedance and a second input gain, and wherein at least one of said first and second input impedances and of said first and second input gains are respectively different from one another.

6. A hearing aid comprising:

a microphone;

an electromagnetic shielding case for encapsulating said microphone; and an analog/digital converter mounted on an outer surface of said electromagnetic shielding case and electromagnetically shielded from said microphone.

7. A microphone system with a size for applying in a hearing aid comprising:

a microphone system encapsulated in an electromagnetic shielding case; and an analog/digital converter mounted on an outer surface of said electromagnetic shielding case.

8. The system of claim 7, wherein said analog/digital converter is mounted on said outer surface via an electromagnetic shielding case of said analog/digital converter.

9. The system of claim 7, wherein said analog/digital converter is fixed to a flexible sheet having a conducting path connected to the digital output of said converter, said sheet with said converter being encapsulated in an electromagnetic shielding case mounted to said outer surface.

10. The system of claim 7, further comprising an electrical connection from an output of said microphone through said shielding case of said microphone to said flexible sheet.

* * * * *